United States Patent [19]

Hoffmann et al.

[11] 3,978,646

[45] Sept. 7, 1976

[54] CONTROL OF BREAK-UP ROLLER SPEED IN OPEN-END SPINNING UNIT

[75] Inventors: Herbert Hoffmann, Bremen; Rolf Neubert, Schwanewede (Beckedorf); Friedrich Wachendorf, Schwanewede, all of Germany

[73] Assignee: Fried. Krupp Gesellschaft mit beschrankter Haftung, Essen, Germany

[22] Filed: Apr. 25, 1975

[21] Appl. No.: 571,628

[30] Foreign Application Priority Data

May 6, 1974 Germany ..... 2421783

[52] U.S. Cl. ..... 57/58.95; 57/58.89; 57/58.91; 57/156

[51] Int. Cl.[2] ..... D01H 1/12

[58] Field of Search ..... 57/34 R, 58.89–58.95, 57/156

[56] References Cited

UNITED STATES PATENTS

| | | | |
|---|---|---|---|
| 3,732,681 | 5/1973 | Kutscher et al. | 57/58.89 X |
| 3,774,386 | 11/1973 | Kutscher et al. | 57/58.95 |
| 3,841,075 | 10/1974 | Kutscher et al. | 57/58.91 |
| 3,875,733 | 4/1975 | Wehling | 57/58.95 |
| 3,882,666 | 5/1975 | Müller | 57/58.89 X |

*Primary Examiner*—Donald E. Watkins
*Attorney, Agent, or Firm*—Spencer & Kaye

[57] ABSTRACT

In an open-end yarn spinning unit, a break-up roller which is driven by transmission of driving force from the spinning rotor, without mechanical contact between the roller and the rotor, is subjected to a speed regulation by application of a retarding force without mechanical connection between the roller and the source of each retarding force.

15 Claims, 8 Drawing Figures

CONTROL OF BREAK-UP ROLLER SPEED IN OPEN-END SPINNING UNIT

BACKGROUND OF THE INVENTION

The present invention relates to a method for limiting the rate of rotation of the break-up rollers of an open-end spinning unit of the type in which the break-up roller is mounted without a mechanically-connected drive and is caused to rotate without contact by the spinning rotor which is arranged coaxially thereto. The invention also relates to apparatus operating according to the method.

In such an arrangement, the break-up roller can be driven, without mechanical contact with the drive source, by a stream of air produced by the spinning rotor or by eddy current fields produced with the aid of a system of magnets which create a reciprocal magnetic effect between the break-up roller and the spinning rotor.

Such a so-called indirect drive has the advantage of involving a particularly simple structure; the break-up roller is carried along, without any additional drive means, by the stream of air or the magnetic effect, in the direction of rotation of the spinning rotor, which is connected to a drive assembly.

One drawback of the indirect drive, where no mechanical connection exists between the driving and the driven component, is that the rate of rotation of the break-up roller is dependent inter alia, on the type and quantity of the fed-in fibers. Thus, when the machine is empty there exists the danger that the break-up roller will rotate at too high a rate.

Such unduly high rates of rotation could be avoided by providing the break-up roller with centrifugally or speed controlled friction surfaces, for example braking jaws or braking pins, which become effective when a limit speed is being exceeded, to brake the break-up roller. Such control devices, however, are subject to wear and are structurally complicated so that they do not represent a satisfactory solution in the normal case.

SUMMARY OF THE INVENTION

It is therefore an object of the present invention to limit the rate of rotation of an indirectly driven break-up roller of such a spinning unit through the use of means which do not add greatly to the cost of the unit.

This and other objects of the invention are achieved, according to the invention, by providing, simultaneously with the driving moment furnished by the spinning rotor, a variable retarding moment, also produced without contact, i.e., without forming a mechanical connection with the stationary surroundings, which delaying moment becomes effective at the break-up roller and counteracts the driving moment.

Preferably, the delaying, or retarding, moment is varied in dependence on the number of revolutions of the break-up roller.

According to one embodiment of the method of the invention, the rate of rotation of the break-up roller can be influenced by producing ventilation losses by means of air resistance surfaces which rotate together with the break-up roller, which ventilation losses counteract further acceleration of the break-up roller when a limit speed has been reached.

A braking stream of air can additionally be directed toward the air resistance surfaces, the intensity of the stream being regulated in dependence on the rate of rotation of the break-up roller. The magnitude of the delaying moment produced by means of the braking stream of air can also be influenced by, in addition to varying the intensity of the braking stream of air or with constant intensity of the braking stream of air, regulating the magnitude of the effective flow cross sections within the break-up roller housing in dependence on the rate of rotation of the break-up roller.

Aside from the above-described possibilities for producing the delaying moment by flow-mechanical means, this delaying moment can also be produced electromagnetically.

According to these embodiments of the process, a magnetic field produces eddy currents in an electrically conductive counter-surface, the latter being penetrated by the magnetic field as it moves with respect thereto, which eddy currents counteract the rotation of the break-up roller due to the magnetic effect on the stationary portion, the intensity of the magnetic field increasing as the rate of rotation of the break-up roller increases. In these embodiments, the magnetic field is produced by a system of electromagnets capable of producing a variable field intensity.

It is also possible, however, to simply regulate the intensity of the magnetic field by varying the distance from the conducting countersurfaces with which it interacts. The method can also be practiced with the aid of a system which includes permanent magnets.

The apparatus for practicing the method in which a retarding moment is produced by mechanical air flow generating means, in its simplest embodiment, includes a break-up roller which is designed with respect to its dimensions, e.g., diameter, width of circumferential surface, and with respect to the type of comb surface, for example sawtooth wire, so that the ventilation losses produced by the comb surface correspond to a certain rate of rotation of the transmitted drive energy. By rotating the jacket and the lining attached thereto, a brake moment is produced which increases in proportion with the third power of the rate of rotation of the break-up roller. In many cases, the break-up roller can thus be designed so that the air friction moment produced thereby exceeds the drive moment, beginning with a certain rate of rotation, thus preventing further acceleration of the break-up roller.

If such a configuration of the break-up roller is impossible, i.e., if the ventilation losses produced by the break-up roller itself are not sufficient to limit the speed of the break-up roller, the roller is advantageously provided with additional means for generating ventilation losses, for example with vanes.

The speed of the break-up roller can be regulated by the vanes in a particularly simple manner by making them adjustable in response to centrifugal forces so that they assume a position, when the limit speed has been reached, at which the ventilation losses are particularly high.

The adjustability of the vanes can here be achieved by constructing them to be elastically deformable in the radial direction.

According to another advantageous embodiment of the present invention, the vanes are connected with the break-up roller through the intermediary of supporting elements which are elastically deformable in the radial direction.

According to a further modification of this embodiment, the vanes are displaceably arranged in substantially radial guide bores provided in the break-up roller, the mechanical connection between the break-up roller and the vanes being a biased tension spring. The vanes are thus displaced in a radial direction only when the centrifugal force acting on the vanes overcomes the resetting force of the tensioned spring.

According to another embodiment of the present invention, the vanes have associated with them a stationary nozzle which is connected via a pressure line to a known pressure generating device and which has a variable outlet cross section. The vanes, which may be arranged axially or radially with respect to the break-up roller, in this embodiment are rigid and are immovably connected with the break-up roller.

The apparatus used to practice the present invention, in which the retarding moment is produced electromechanically, is characterized in that the break-up roller and the housing have respective axially spaced surfaces disposed opposite to one another and a multiple-pole system of magnets is disposed in one of those surfaces, while the other one of the surfaces constitutes a countersurface made of electrically conductive material, at least in the region facing the system of magnets.

The effect of the magnetic field produced by the system of magnets is made variable by mounting the system of magnets in the housing of the break-up roller to be displaceable in the axial direction.

It is of course also conceivable that a system of magnets including permanent magnets is disposed in the break-up roller and the countersurface of electrically conductive material is connected with the housing of the break-up roller so as not to be rotatable but to be axially displaceable.

In a particularly advantageous embodiment of the present invention the system of magnets is constructed to include electromagnets and a variable resistor connected in the circuit supplying current to the electromagnets in order to permit variation of the magnetic field intensity. The electromagnets are here stationarily disposed in the housing of the break-up roller and this simplifies connection of the stationary magnet system to its associated energy source.

DESCRIPTION OF THE PREFERRED EMBODIMENTS

Figure 1:
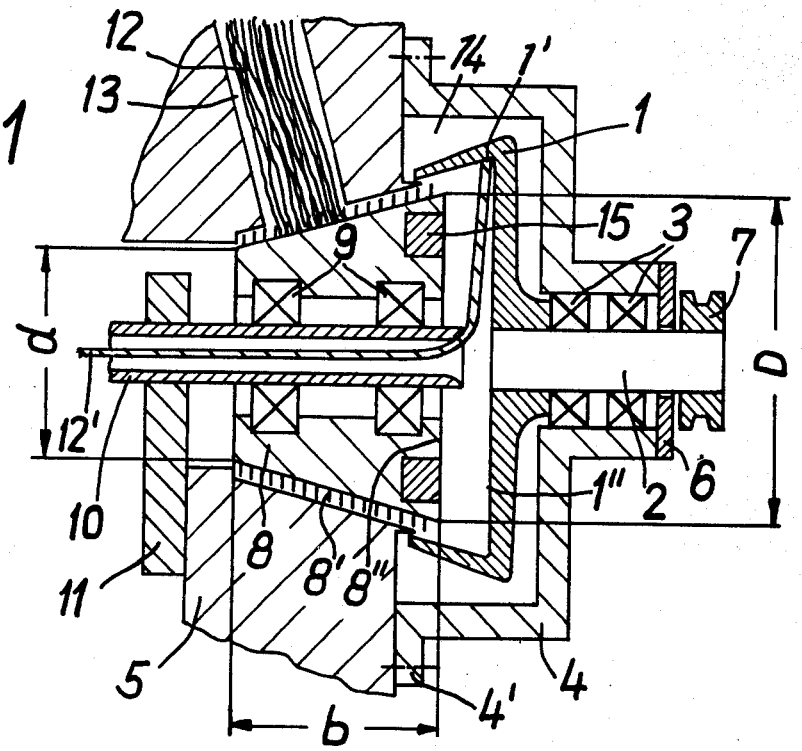
FIG. 1 is a simplified cross-sectional view of an open-end spinning unit with a break-up roller which is indirectly driven by a coaxially arranged spinning rotor and which is provided with one embodiment of the invention.

The open-end spinning unit shown in FIG. 1 substantially includes a spinning rotor 1 which is mounted in a rotor housing 4 to be rotatable via a rotor shaft 2 supported by bearings 3.

The housing 4 is tightly connected to the break-up roller housing 5 via a flange 4' and is covered on its outside by means of a lid 6. A drive pulley 7 is fastened to rotor shaft 2 to drive the spinning rotor, for example by means of a tangential belt (not shown).

The break-up roller 8 is arranged coaxially with the spinning rotor 1 and is supported via bearing 9 on a yarn extraction tube 10, the latter being immovably connected to the break-up roller housing 5 by means of a plurality of supporting arms 11.

The fiber material 12 to be processed is fed to the break-up roller 8 through a feed channel 13, is broken up by means of the comb assembly 8' and is fed by the action of a draft of air present in the spinning chamber 14, into the fiber collecting trough 1' of the spinning rotor 1. The finished yarn 12' formed in the region of the fiber collecting trough is extracted to the outside through tube 10 by means of a known device, for example by means of a pair of yarn extraction rollers.

The break-up roller 8, which is mounted without being connected to any drive member, is provided on its frontal face 8'' facing the spinning rotor with an annular permanent magnet 15 having axially magnetized poles. The bottom surface 1'' of the spinning rotor 1 disposed opposite the annular magnet 15 is made of electrically conductive material, at least in the region coextensive with the annular magnet. The magnetic field produced by the permanent magnet 15 generates eddy currents in the rotating spinning rotor 1 which effect the driving of the break-up roller 8.

The dimensions of the break-up roller 8, i.e., its minimum and maximum diameters *d* and D and its axial length, or the width of its circumferential surface, *b*, as well as the type of the comb assembly 8' attached around its periphery — which may be made of pins or sawtooth wire, for example — are selected so that the ventilation losses associated with the rotation of the break-up roller constitute a braking moment which at a given rate of rotation of the break-up roller exceeds the drive energy produced by the interaction between the break-up roller and the spinning rotor; thus the indirect drive can never accelerate the break-up roller beyond a limit speed.

For a spinning rotor of a speed of 40,000 rpm the maximum speed limit of the break-up roller is for example 15,000 rpm. This speed will not be exceeded, if the dimensions of the break-up roller are D = 70 mm, $d = 50$ mm and $b = 80$ mm. In addition the roller clothing should be coarse, for example provided with teeth of 4 mm height and a population of only 50 to 100 teeth per square inch.

Figure 2:
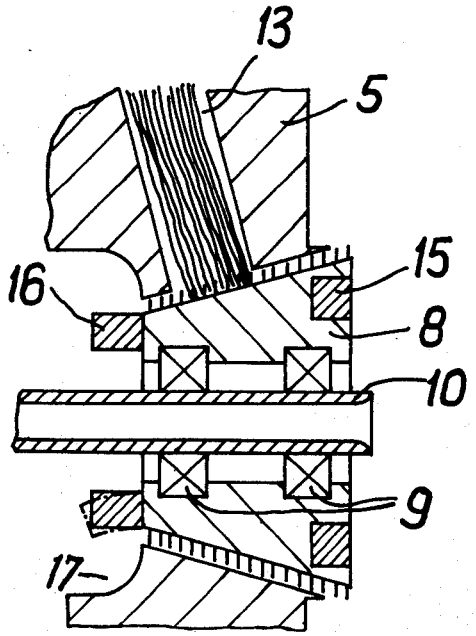
FIG. 2 is a cross-sectional view of the break-up roller housing and the break-up roller, the latter being provided with axially arranged vanes which are elastically deformable in the radial direction according to another embodiment of the invention.

The retarding moment can be augmented, as shown in FIG. 2, by fastening vanes 16 to the frontal face of break-up roller 8 which faces away from the spinning rotor. Vanes 16 extend axially and are preferably made of an elastically deformable material which permits displacement of the free vane ends toward the outside, indicated by dash-dot lines, when the speed of the break-up roller increases, which displacement increases the braking moment.

For a break-up roller of similar dimensions as indicated in FIG. 1 the vanes 16 allow reducing the speed limit to 12,000 rpm, for example, if they are made of rubber sheets with an axial length of 25 mm and a radial width of 10 to 15 mm.

The number of vanes 16 should be 4 to 8, the outward displacement of the free vane ends being about 5 to 10 mm, if the speed limit of 12,000 rpm is exceeded. This displacement increases the braking moment of the vanes 16 by about the factor 3.

The braking effect of vanes 16 can additionally be augmented by designing the portion of the break-up roller housing 5 which lies within the range of the vanes as an air extraction ring 17 which assures a particularly effective flow of air through vanes 16.

Figure 3:
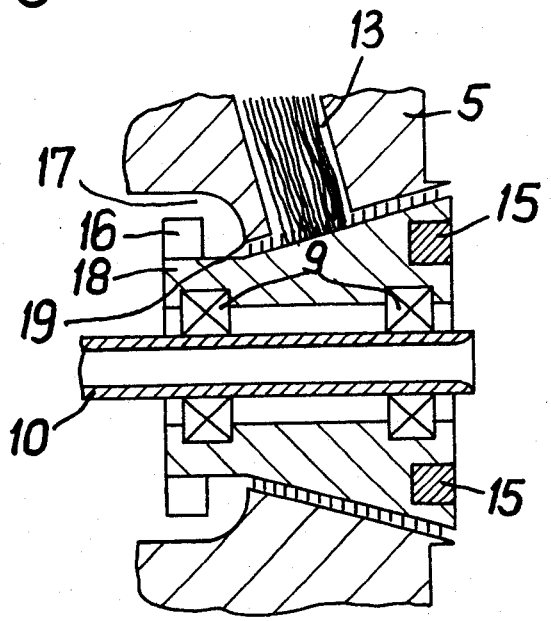
FIG. 3 is a view similar to that of FIG. 2 of a break-up roller housing and a break-up roller with radially arranged rigid vanes according to another embodiment of the invention.

Vanes 16, however, may also, as shown in FIG. 3, be made rigid and fastened to a cylindrically shaped extension 18 of the break-up roller 8.

The portion of the break-up roller housing 5 which surrounds vanes 16 is here, as already described, designed as an annular chamber. The stream of air produced by the rigid vanes 16 can simultaneously be used to aid the fiber transport from the feed channel 13 into the fiber collection trough of the spinning rotor 1. The annular chamber 17 thus communicates with the feed channel 13 via annular opening 19.

Figure 4:
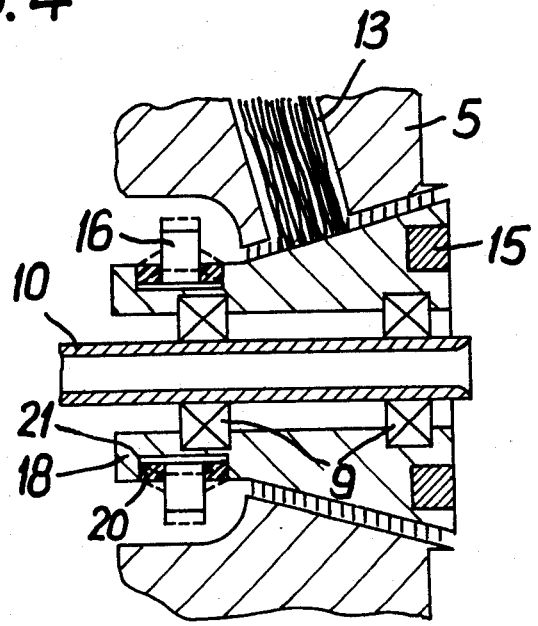
FIG. 4 is a view similar to that of FIG. 2 of a break-up roller housing and a break-up roller where the radially arranged vanes are held by means of elastically deformable connecting elements according to another embodiment of the invention.

Another possibility of limiting the speed by adjusting vanes 16 is shown in FIG. 4. The rigid vanes 16 are here held by an elastically deformable connecting element 20 which itself is fastened in an annular recess 21 in the extension 18 of the break-up roller 8.

When the speed of the break-up roller 8 increases, the vanes 16 are urged radially outwardly, against the resetting force of the connecting elements 20, by the centrifugal force acting on the vanes 16 into the position shown in dash-dot lines, so that the ventilation losses are increased. With a suitable design of vanes 16 as well as connecting element 20 it is possible to realize a certain curve for the braking moment characteristic in dependence on the speed of the break-up roller and thus a limitation of the speed of the break-up roller.

An effective braking is realized, if the vanes 16 have a blade area of for example 5 cm², the outer diameter of section 18 of the break-up roller being about 50 mm and the speed limit again 12,000 rpm.

The elastic body 20 consists of rubber and surrounds section 18 like a belt of 50 mm/ 45 mm outer/inner diameter and 30 mm width, insolubly connected to the blades and to the axial counterfaces of the section 18. The number of blades is four to eight.

Figure 5:
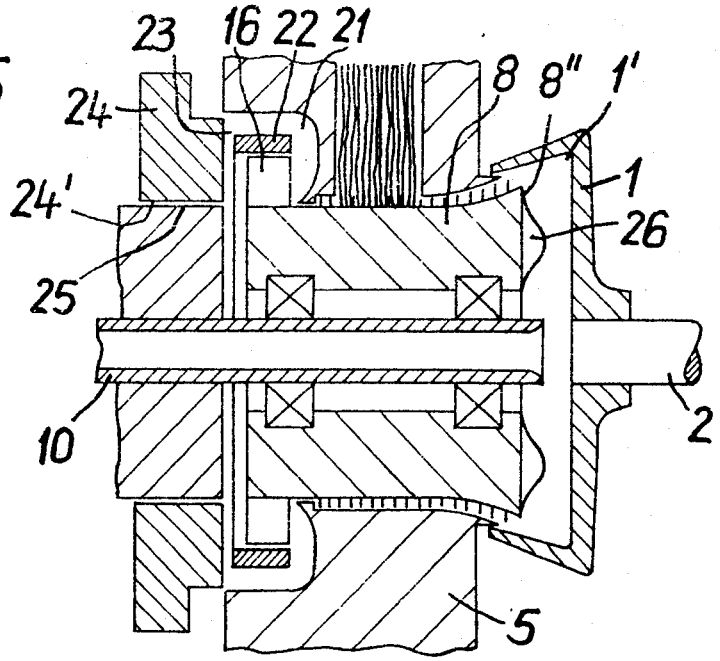
FIG. 5 is a view similar to that of FIG. 1 of an open-end spinning unit with a break-up roller having rigid vanes and an annular channel associated with the vanes, the channel having a variable return flow cross section according to another embodiment of the invention.

In the embodiment shown in FIG. 5 the vanes 16 produce, in the manner of an axial ventilation system, an annular flow through a path 21 about a stationarily mounted annular element 22. The annular flow can be influenced by varying the cross-sectional area of the return flow 23 between members 22 and 24 by making member 24 to be an axially displaceable adjustment sleeve. The adjustment sleeve 24 is not rotatable and is supported via its inner surface 24' on a stationary guide surface 25. This guide surface is part of a housing section which simultaneously accommodates the yarn extraction tube 10. By displacing the adjustment sleeve 24 toward the left, i.e., enlarging the return flow cross section 23, the resistance within the annular channel formed by the annular element 22 and thus the braking moment generated by vanes 16 is decreased.

The previously described embodiments can be modified to cause rotation of the break-up roller as a result of the vane-type surfaces 26 provided in the region of the frontal face 8'' of break-up roller 8 encountering the stream of air generated by the spinning rotor 1.

Figure 6:
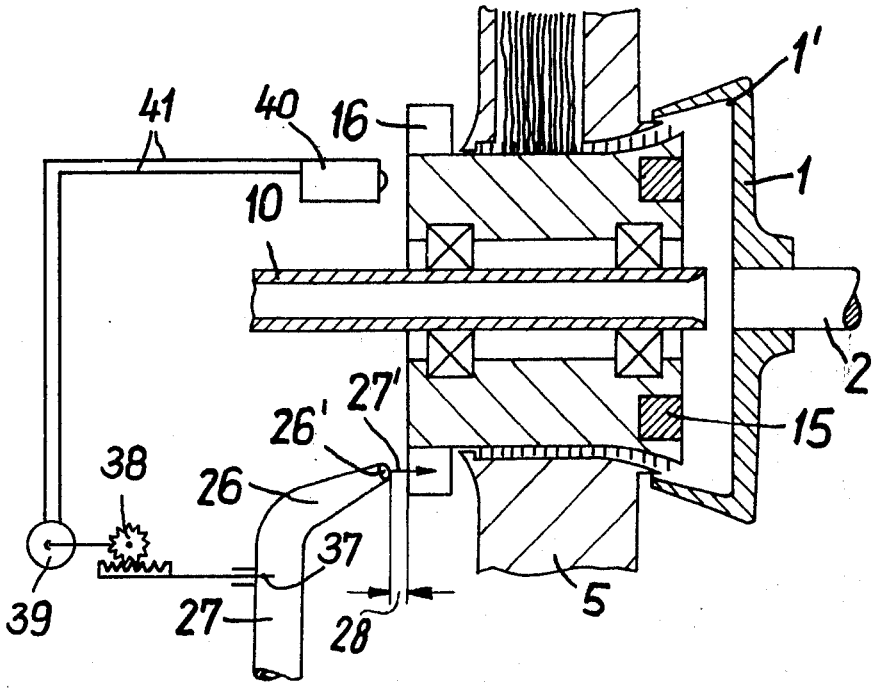
FIG. 6 is a view similar to that of FIG. 5 of an open-end spinning unit where the break-up roller is provided with rigid vanes and can be braked by means of a stream of braking air from a nozzle according to another embodiment of the invention.

The rate of rotation of the break-up roller 8 can, however, also be influenced by directing toward the vanes a braking stream of air which counteracts the direction of rotation of the spinning rotor, as shown in FIG. 6.

The vanes 16 are here disposed opposite the opening 26' of a nozzle 26. The nozzle itself is connected via a tubular line 27 with a known pressure generating device (not shown). The magnitude of the braking moment produced by the braking stream of air 27' can be influenced in a simple manner by changing either the distance between opening 26' and the vanes 16 or the size of opening 26'.

Referring to the aforementioned dimensions and speed ranges of the break-up roller, the vanes 16 should have an area of 1 cm², their number being 8 to 16. Opening 26' has a diameter of 0.2 cm², the distance 28 being not more than 5 mm, the air velocity in opening 26' about 60 m/s and the angle of impingement 45°.

The air velocity at opening 26' can be regulated by moving the blade 37, which reduces the cross-section of valve 27 by moving inward. The blade 37 is connected with a drive means 38, forming a rack-and-pinion-gear which transforms rotational movement from an electrically driven positioning motor 39 into transversal motion. The motor 39 is connected by wires 41 to a regulation device 40, which measures the speed of the break-up roller photo-electrically and regulates it via parts 37, 38, 39, and 40 to the desired value.

Figure 7:
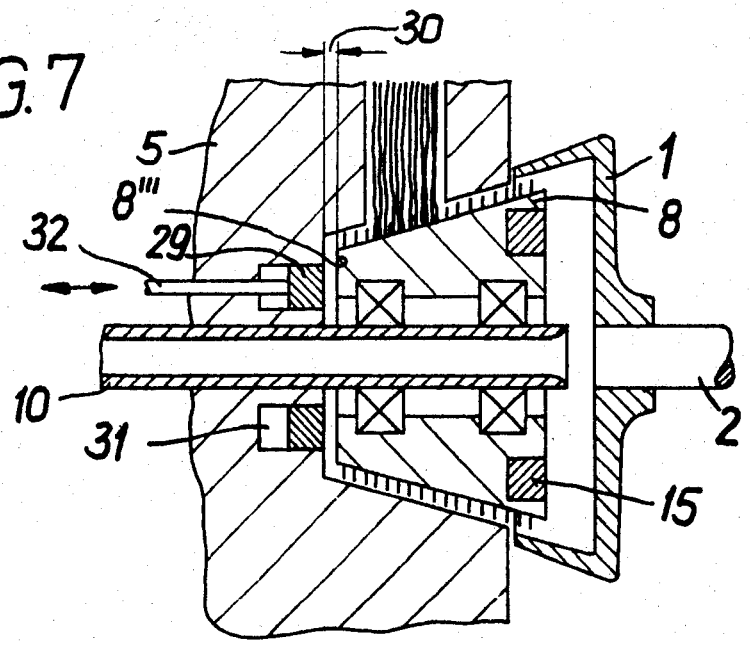
FIG. 7 is a view similar to that of FIG. 5 of an open-end spinning unit where the break-up roller is disposed opposite to and spaced from a system of magnets including permanent magnets, the system being displaceable in axial direction, according to another embodiment of the invention.

The rate of rotation of the indirectly driven break-up roller 8 can be influenced or regulated by placing its rearward frontal face 8''' opposite and spaced from an axially displaceable system of magnets, as shown in FIG. 7.

The system of magnets here includes an annular permanent magnet 29 with a circumferentially spaced plurality of axially polarized poles. By rotating the frontal face 8''', which is made of an electrically conductive material, with respect to the stationary permanent magnet 29, eddy currents are produced in the break-up roller 30 which eddy currents result in an alternating effect between the permanent magnet 29 and the break-up roller 8. This effect acts to brake the rotation of the break-up roller 8. The field intensity of the permanent magnet 29 which acts on the break-up roller can be influenced by varying the distance 30 between the two parts which take part in the alternating effect.

For this purpose, the permanent magnet 29 is disposed in an annular axial bore 31 of the break-up roller housing 8 and is moved in the axial direction, indicated by the arrows, under the control of a displacement rod 32 which is part of a displacement device (not shown).

The displacement device may here be controlled by a parameter sensor which feeds a signal representing deviations in the speed of the break-up roller from a rated value into the setting device. If, for example, the speed of the break-up roller exceeds a certain limit value, the permanent magnet 29 can be displaced to the right to reduce the distance 30 and thus increase the braking moment acting on the break-up roller. The speed of the break-up roller consequently decreases. If it drops below a given braking speed, the distance 30 is increased and thus the braking moment is reduced.

The revolution generator may be, for example, a tachometer which produces, across its output terminals, a voltage proportional to the rotation speed of the break-up roller.

The magnet 29 has for example six poles, the field strength being equivalent to about 10,000 Gauss, referred again to a break-up roller 8 of 50 to 70 mm in diameter driven at 10,000 to 12,000 rpm. The roller material is for example aluminum, the distance 30 being 3 to 5 mm.

Figure 8:
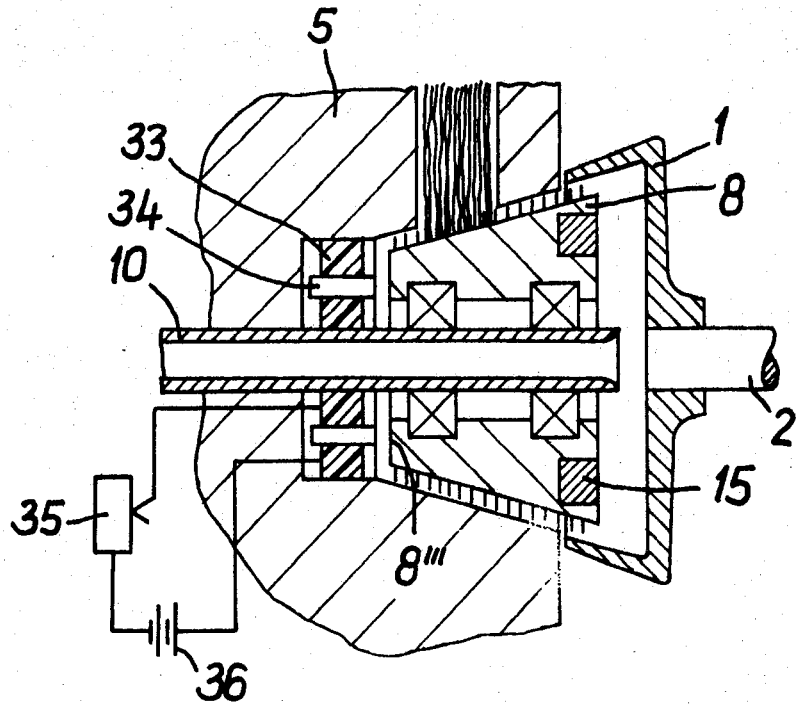
FIG. 8 is a view similar to that of FIG. 5 of an open-end spinning unit including a magnet system of electromagnets where the field intensity of the magnets can be influenced by changing the magnitude of the magnetizing current by means of an adjustable resistor, according to another embodiment of the invention.

In modification of the above-described embodiment, the magnet system may also include electromagnets with magnetic windings 33 and poles 34, as shown in FIG. 8.

The braking moment produced by means of the electromagnets can be varied in that the magnetic windings 33 are connected, via the intermediary of a variable resistor 35, to a direct current source 36.

The resistor 35, and thus the magnitude of the magnetization current, can be set in a known manner by a setting device which is controlled by a rotational speed sensor The distance between poles 34 and the frontal face 8''' need not be variable since the intensity of the magnetic field of the magnet system can be varied over a continuous range, in contradistinction to the embodiment shown in FIG. 7, by moving the slider of resistor 35 in a manner to vary the magnitude of the magnetization current.

The types of control for the speed of the break-up roller described above can be applied from a central location for all or at least a plurality of break-up rollers in a spinning machine including a plurality of units. It is also possible, however, to influence, or control, the speed of each break-up roller individually.

It will be understood that the above description of the present invention is susceptible to various modifications, changes and adaptations, and the same are intended to be comprehended within the meaning and range of equivalents of the appended claims.

What is claimed is:

1. A method for limiting the rate of rotation of the break-up roller of an open-end spinning unit in which the break-up roller is free of mechanical connection to any drive system and is mounted to be freely rotatable and the break-up roller is caused to rotate by a force transmission from the coaxially arranged spinning rotor of the unit without any mechanical contact between the roller and the rotor, said method comprising imparting a variable retarding force to said break-up roller to produce a braking moment while preventing mechanical connection between said roller and any stationary body.

2. A method as defined in claim 1 wherein said step of imparting includes varying the retarding force in proportion to the rate of rotation of said roller.

3. A method as defined in claim 2 wherein said retarding force is produced by the action of members mounted for rotation with said roller and presenting air resistance surfaces which produce ventilation losses when said roller is rotating, which losses vary in magnitude with roller speed and are sufficient to prevent said roller from rotating at a speed greater than a predetermined limit value.

4. A method as defined in claim 3 wherein said step of imparting further comprises directing a stream of braking air toward said air resistance surfaces in a direction to oppose roller rotation, the intensity of said stream of air being regulated in dependence on the rate of rotation of said break-up roller.

5. A method as defined in claim 1 wherein at least a portion of said roller is made of electrically conductive material and said step of imparting is carried out by providing a magnetic field which traverses such roller portion to induce in such portion eddy currents which establish such retarding force, and varying the magnetic field intensity within such roller portion in proportion to variations in the rate of rotation of said roller.

6. A method as defined in claim 5 wherein the magnetic field is generated by an electromagnet system producing a magnetic field of variable intensity.

7. A method as defined in claim 5 wherein the magnetic field is produced by a magnet and said step of varying is carried out by varying the distance between the magnet and such roller portion.

8. In an open-end spinning unit having a coaxially mounted spinning rotor and a break-up roller which is free of mechanical connection to any drive system and which is mounted to be freely rotatable, the break-up roller being caused to rotate by a force transmission from the coaxially mounted spinning rotor of the unit without any mechanical contact between the roller and the rotor, the improvement wherein said break-up roller has a circumferential surface constituted by a comb wherein rotation of said roller causes said comb to produce ventilation losses constituting a variable retarding force applied to said break-up roller to produce a braking moment while preventing mechanical connection between said roller and any stationary body, and said roller is dimensioned and said comb is formed to cause the retarding force produced by said ventilation losses to have a value which corresponds to the force applied to drive said roller at a selected roller rotation speed.

9. In an open-end spinning unit having a coaxially mounted spinning rotor and a break-up roller which is free of mechanical connection to any drive system and which is mounted to be freely rotatable, said break-up roller being caused to rotate by a force transmission from said coaxially mounted spinning rotor without any mechanical contact between said roller and said rotor, the improvement comprising means disposed for imparting a variable retarding force to said break-up roller to produce a braking moment while preventing mechanical connection between said roller and any stationary body, and wherein said roller comprises a plurality of vanes presenting air resistance surfaces producing at least part of said retarding force.

10. An arrangement as defined in claim 9 where said vanes are elastically deformable and are arranged to be deflected radially outwardly under the influence of the centrifugal forces resulting from rotation of said roller.

11. An arrangement as defined in claim 9 further comprising elastically deformable means connecting said vanes to said roller and arranged to be deformed in a manner to move said vanes radially outwardly under the influence of the centrifugal forces resulting from the rotation of said roller.

12. In an open-end spinning unit including a coaxially mounted spinning rotor and a break-up roller member which is free of mechanical connection to any drive system and which is mounted to be freely rotatable, said break-up roller member being caused to rotate by a force transmission from said coaxially mounted spinning rotor without any mechanical contact between said roller member and said rotor, wherein said unit includes a stationary housing member defining a surface facing, and spaced from, an associated surface of said roller member, the improvement comprising a multiple pole magnet system disposed in one of said members at the said surface of said one member, and a body of electrically conductive material forming part of the other of said members and disposed at the said surface of said other member, relative rotation between said members resulting in the creation of eddy currents in said conductive material by the magnetic field produced by said magnet system in a manner to tend to retard rotation of said roller member without mechanical connection between said roller member and any stationary body.

13. An arrangement as defined in claim 12 wherein said magnet system comprises permanent magnets, and further comprising means mounting said magnets in said housing for displacement toward and away from said roller in order to vary the retarding force produced by said magnets.

14. An arrangement as defined in claim 12 wherein said magnetic system comprises: at least one electromagnet; a current source therefor; and a variable resistor connected in circuit with said electromagnet and said source for varying the intensity of the magnetic field produced by said electromagnet and thus the retarding force produced thereby.

15. In a procedure for spinning fibers into yarn in an open-end spinning unit having a coaxially mounted spinning rotor and a break-up roller, the break-up roller being free of mechanical connection to any drive system, being mounted to be freely rotatable, and being caused to rotate by a force transmission from the coaxially arranged spinning rotor of the unit without any mechanical contact between the roller and the rotor, during which procedure the delivery of fibers to the unit can be temporarily stopped, the improvement comprising imparting a variable retarding force to said break-up roller to produce a braking moment which limits the rate of rotation of said break-up roller, while preventing mechanical connection between said roller and any stationary body.

* * * * *